US010112758B2

(12) United States Patent
Beyer

(10) Patent No.: US 10,112,758 B2
(45) Date of Patent: Oct. 30, 2018

(54) PRODUCT PACKAGING CONTAINING A SOLID PRODUCT BLOCK

(71) Applicant: Ecolab USA Inc., Saint Paul, MN (US)

(72) Inventor: Sarah Beyer, Dusseldorf (DE)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 15/218,953

(22) Filed: Jul. 25, 2016

(65) Prior Publication Data

US 2016/0332793 A1 Nov. 17, 2016

Related U.S. Application Data

(63) Continuation of application No. PCT/EP2013/074709, filed on Nov. 26, 2013.

(51) Int. Cl.

| | |
|---|---|
| ***B65D 75/00*** | (2006.01) |
| ***B65D 85/84*** | (2006.01) |
| ***C11D 17/00*** | (2006.01) |
| ***C11D 17/04*** | (2006.01) |

(52) U.S. Cl.

CPC ..... *B65D 75/004* (2013.01); *B65D 85/84* (2013.01); *C11D 17/0047* (2013.01); *C11D 17/04* (2013.01); *C11D 17/041* (2013.01); *C11D 17/044* (2013.01)

(58) Field of Classification Search

CPC .. A01N 25/34; A47K 5/05; A61L 9/05; B29K 2105/20; C11D 17/0047–17/0095; C11D 17/0056; C11D 17/04–17/048; E03D 2009/024; E03D 9/032; B65D 85/84

USPC ..... 206/477; 4/231

See application file for complete search history.

(56) References Cited

U.S. PATENT DOCUMENTS

| | | | | |
|---|---|---|---|---|
| 2,243,634 | A | 5/1941 | Kadish | |
| 3,668,717 | A | 6/1972 | Curran | |
| 5,087,188 | A * | 2/1992 | Staver | A47K 5/05 249/68 |
| 5,316,688 | A | 5/1994 | Gladfelter et al. | |
| 2004/0055904 | A1 * | 3/2004 | Cummings | B65D 71/22 206/77.1 |
| 2008/0190447 | A1 | 8/2008 | Simonette | |

(Continued)

FOREIGN PATENT DOCUMENTS

| | | |
|---|---|---|
| CN | 202848205 U | 4/2013 |
| CN | 203112796 U | 8/2013 |

(Continued)

OTHER PUBLICATIONS

Ecolab Inc., PCT/EP2013/074709 filed Nov. 26, 2013 "Written Opinion of the International Searching Authority", dated Aug. 14, 2014, 4 pages.

*Primary Examiner* — Anthony Stashick
*Assistant Examiner* — Mollie Impink
(74) *Attorney, Agent, or Firm* — McKee, Voorhees & Sease, PLC

(57) ABSTRACT

A product packaging may include a solid product block for a dispenser system comprises a solid product block having a top, sides, and a bottom, a handle attached to the top of the solid product block, and a water-soluble foil enclosing the solid product block or the handle. Thus, a safe handling of the solid product block when loading or unloading the substance from a dispenser is enhanced without the risk of a person handling the substance getting into direct contact with the substance.

8 Claims, 3 Drawing Sheets

(56) References Cited

U.S. PATENT DOCUMENTS

| | | | |
|---|---|---|---|
| 2008/0190457 | A1 | 8/2008 | Veltman et al. |
| 2010/0146687 | A1 | 6/2010 | King et al. |

FOREIGN PATENT DOCUMENTS

| | | | |
|---|---|---|---|
| JP | 624800 | A | 1/1987 |
| JP | 1992062189 | U | 5/1992 |
| JP | H0738277 | | 7/1995 |
| JP | 11001951 | A | 1/1999 |
| JP | 2003341681 | A | 12/2003 |
| JP | 083658 | | 3/2004 |
| JP | 2010518243 | A | 5/2010 |
| JP | 224353 | | 10/2013 |
| SK | 281450 | B6 * | 3/2001 |
| WO | 2007148054 | A1 | 12/2007 |
| WO | 2008100393 | A1 | 8/2008 |

* cited by examiner

PRODUCT PACKAGING CONTAINING A SOLID PRODUCT BLOCK

CROSS REFERENCE TO RELATED APPLICATIONS

This application is a continuation application of PCT/EP2013/074709, filed on Nov. 26, 2013, the contents of which are incorporated by reference in its entirety.

TECHNICAL FIELD OF THE INVENTION

The present invention relates to a product packaging containing a solid product block, in particular for a dispenser system.

BACKGROUND OF THE INVENTION

Solid products are dispensed in solid product dispensers, for example by spraying or flushing with water, to create a use solution. Some solid products are caustic or corrosive and should not be handled by coming into direct contact with the solid products. This is particularly true in industrial laundry, wear washing, and floor care products.

To package solid products, for example, thermo-formed blister packs and packages with lids are commonly used. However, these types of packages typically require the user to remove a lid from the package and drop the solid products into the dispenser. This technique exposes the user to contact the solid products directly, which is not desirable, and provides no means for handling the solid product in case a removal might be necessary.

Another type of packaging solid products are shrink-wrapped foils. Small holes in the foil allow the evacuation of otherwise trapped air as the film shrinks to conform to the shape of the solid product. Through these small holes, moisture from the atmosphere might enter the package, which may cause the solid product to swell and at least partially dissolve. This may lead to the user coming into direct contact with the solid product that has escaped through the shrink-wrapped foil. Thus, it is challenging to load solid products into dispensers without touching the solid product. Also a removal of a solid product from a dispenser, for example in case of a blockage, is not possible with this type of packaging and what bring the user into direct contact with the solid product.

It is therefore an object of the present invention to provide a product packaging for holding a substance, preferably a solid product, which enables a safe handling of the product, in particular when loading or unloading the substance from a dispenser, without the risk of a person handling the substance to get into direct contact with the substance.

SUMMARY OF THE INVENTION

This object is solved by a product packaging according to claim 1 of the present invention. Preferred embodiments, additional details, features, characteristics and advantages of the object of the invention of said product packaging are disclosed in the sub-claims.

Accordingly, a product packaging containing a solid product block, in particular for a dispenser system, comprises a solid product block having a top, sides and a bottom, a handling means attached to the top of the solid product block, and a wrapping means enclosing the solid product block and/or the handling means.

The handling means may be directly attached to the top of the solid product block, for example by enclosing or encompassing part of the solid product block, for example by means of a band or trip attached to the handling means and surrounding the solid product block, thus fixing the handling means in a position attached to the top of the solid product block. The wrapping means may be a rigid or flexible material enclosing the solid product block, for example a foil or a thermoformed plastic. The handling means may be attached to the top of the solid product block, wherein in between the solid product block and the handling means the wrapping means may be arranged. This has the advantage that the user handling the solid product block may not get into direct contact with the solid product block enclosed by the wrapping means, when handling the solid product block using the handling means. The wrapping means may also enclose at least part of the handling means and the solid product block. In this case, the wrapping means may enclose at least part of the handling means, which would have the advantage that the handling means may directly be attached to the top of the solid product block without wrapping means in between the handling means and the solid product block. Thus, the handling means may be fixed in a position on top of the solid product by the wrapping means. This has the advantage that apart from protecting the user from getting into direct contact with the solid product block, the production costs may be lowered because the wrapping means may wrap the solid product block and at the same time fix the handling means on top of the solid product block. Hence, the product packaging according to the invention has the advantage that a safe handling of the product, in particular when loading or unloading the substance from a dispenser is enhanced without the risk of a person handling the substance getting into direct contact with the substance.

According to a preferred embodiment of the invention, the handling means comprises at least one fastening means form-lockingly connected to the solid product block. In an assembled and a ready-to-use-state of the product packaging containing the solid product block, the at least one fastening means may be at least partially arranged inside the solid product block. The at least one fastening means may comprise a form-locking shape, for example screw-like, comprising a screw-thread or hook-like, allowing for a form-locking connection between the fastening means and the solid product block in an assembled state of the product packaging. The at least one fastening means may be positioned at least partially inside of the solid product block prior to forming of the solid product block, for example when the substance of the solid product block is pressed into its final shape. This has the advantage that the solid product block may be handled even in case the wrapping means has been removed or damaged. Thus, a user may handle the solid product block with or without the wrapping means being in place, without getting directly into contact with the solid product block, and enabling the removal of a used solid product block from a dispenser.

According to an embodiment of the invention, the top of the solid product block comprises at least a first opening configured and arranged to receive the at least first fastening means. The top of the solid product block may further comprise a second opening configured and arranged to receive a second fastening means of a handling means comprising a first and a second fastening means. The first and/or second opening in the top of the solid product block allows for attaching the handling means comprising at least one fastening means to, in particular the top of, the solid product block after the solid product block has been formed, for example by pressing or extruding. The at least one fastening means may for example be snapped form-lockingly into the first opening or may be screwed into the at least first opening. This allows for a reliable and efficient connection of the handling means to the solid product block while reducing the production costs by avoiding expensive fixture cost for integrating the fastening means during the shaping of the solid product block.

According to an embodiment of the invention, the handling means comprises a protective plate, covering at least partially the top of the solid product block. The protective plate may extend at least partially along the top of the solid product block, wherein the protective plate may comprise an outside shape corresponding to the shape of the top side of the solid product block. In an assembled state of the product packaging, the handling means may be shielded by the protection plate from the solid product block. This has the advantage that the hand of a user holding the handling means is shielded from the solid product block, thus allowing for a safe handling of the solid product block, in particular when removing a solid product block, or especially a partially dissolved solid product block from a dispenser.

According to an embodiment of the invention, the handling means is designed in form of a handle or a flexible strip. In case the handling means is designed in form of a handle, the handling means may comprise a first and a second fastening means, which may be arranged on either end of the handle, extending in particular into the solid product block. The handle may be designed in form of a strip comprising a fastening means attached to the solid product block on either end. This allows for a safe handling in particular of a large and/or heavy solid product block. A handling means in form of a flexible strip may comprise one fastening means which may be arranged form-lockingly inside the solid product block. The handling means in form of the flexible strip may comprise a ring-shaped loop on an end arranged away from the solid product block. This loop may be used by a user for holding the flexible strip with for example a finger put through the loop. This allows the user to safely handle in particular small or lightweight solid product blocks. The handling means in form of the flexible strip also has the advantage that the packaging volume may be reduced during transport, as the flexible strip may be arranged in parallel to the top of the solid product block during transport not increasing the transport volume significantly.

According to an embodiment of the invention, the bottom of the solid product block comprises a cavity configured and arranged to receive the handling means when stacking product packages, in particular product packages according to the invention. The cavity arranged in the bottom of the solid product block has the advantage that when stacking product packages according to the invention, the top and bottom surfaces of the solid product blocks may be arranged next to each other without being held apart by the handling means, which allows for a more stable and safer stacking as well as reducing the transport volume of the stacked solid product blocks.

According to an embodiment of the invention, the wrapping means is a water-soluble foil. The foil may be soluble in cold and/or hot water, which has the advantage that the solid product block may be placed inside a dispenser without a user getting into direct contact with the solid product block because the solid product block is covered by the wrapping means until the dispenser starts operating.

According to an embodiment of the invention, the solid product block is formed by pressing or extruding, in particular comprising at least a first opening. The solid product block may be pressed into shape, in particular comprising the at least one fastening means, which may be form-lockingly arranged inside the solid product block during or prior to the pressing of the solid product block. An extruded solid product block may comprise at least a first opening for receiving the at least one fastening means, wherein the first opening may extend from the top to the bottom of the solid product block, which enables an efficient production of the solid product block by extruding.

A further aspect of the invention is a dispenser system for dispensing a soluble solid product block comprising at least one product packaging as previously described.

The afore mentioned components, as well as the claimed components and the components to be used in accordance with the invention in the described embodiments, are not subject to any special exceptions with respect to their size, shape, material selection and technical concept such that the selection criteria known in the pursuant field can be applied without a limitation.

BRIEF DESCRIPTION OF THE DRAWINGS

Additional details, features, characteristics and advantages of the object of the invention are disclosed in the subclaims, the figures and the following description of the respective figures and examples, which—in exemplary fashion—show several embodiments and examples of a canister and a connector closure according to the invention. In the drawings:

The present invention may be used with any solid product. It is understood that the phrase solid product includes solid products, substantially solid products, semi-solid products, and the like. If the solid product is in a shaped form, such as a block, the solid product may be formed in any desired manner including cast methods, extrusion and pressed powder. The solid product may be formulated for a variety of uses such as, but not limited to, a wear washing detergent, a wear washing rinse aid, a vehicle care detergent such as in a carwash, a medical instrument detergent, a clean in place cleaner, a floor cleaner and the like. The solid product may include a variety of different chemicals including acids, bases, hardening agents, sequestering agents, surfactants, builders, enzymes, dies, fragrances, and the like.

Figure 1:
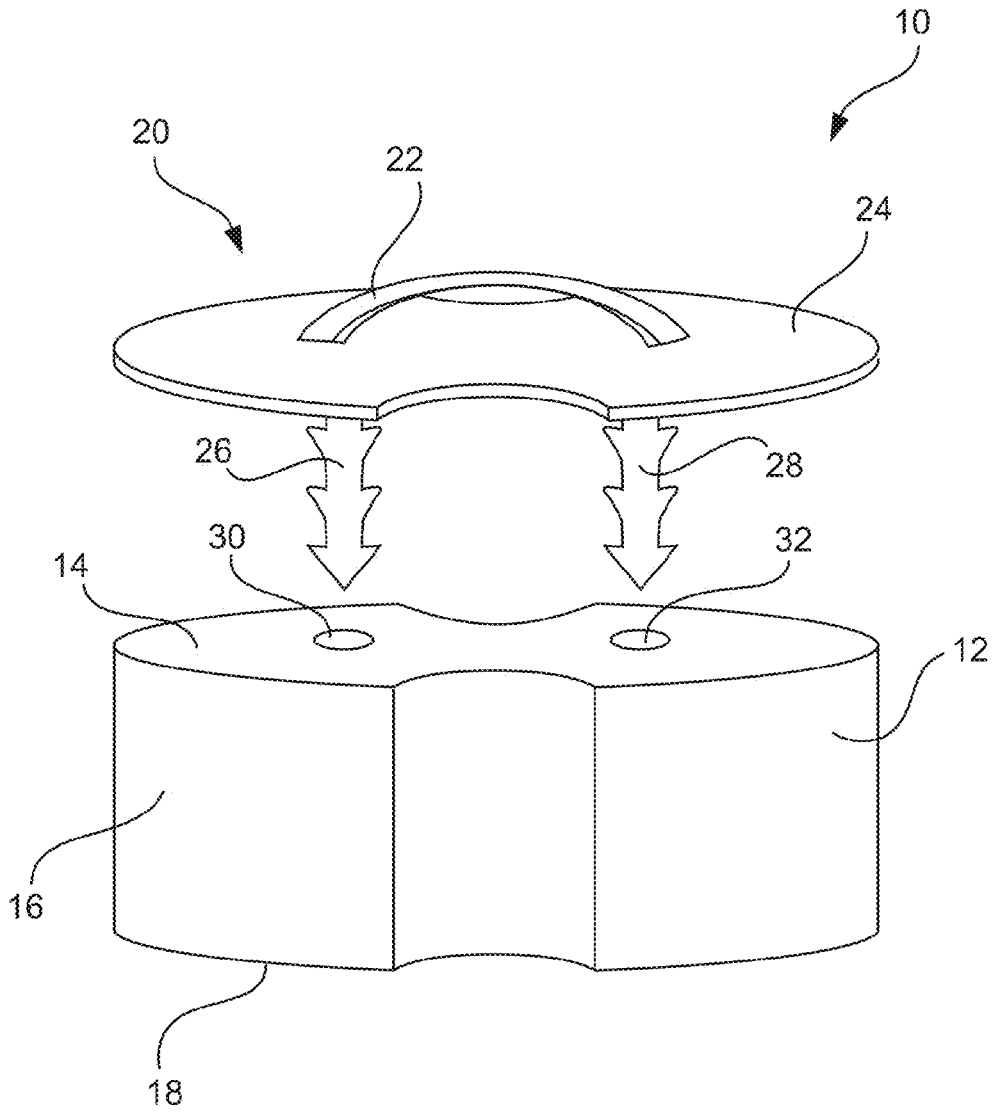
FIG. 1 is a schematic perspective of a product packaging in a disassembled state.

The illustration in FIG. 1 shows a product packaging 10, for example for a dispenser system. The product packaging 10 comprises a solid product block 12, which is designed in a peanut-shaped form. The solid product block 12 comprises a top 14, and sides 16 connecting the top 14 with a bottom 18 of the solid product block 12. The product packaging 10 is shown in a disassembled state, wherein next to the top 14 of the solid product block 12, a handling means 20 in form of a handle 22 is shown, for example in a position prior to an assembly of the handling means 20 to the solid product block 12. The handling means 20 comprises a protective plate 24 for protecting the hand of a user when handling the solid product block 12, wherein the protective plate 24 has a flat shape. The shape of the protective plate 24 corresponds to the shape of the top 14 of the solid product block 12. Thus, in an assembled state of the product packaging 10 the protective plate 24 covers the top 14 of the solid product block 12 completely. The handling means 20 further comprises a first fastening means 26 and a second fastening means 28, wherein the fastening means are arranged on either end of the handle 22, and extend at least partially into the solid product block 12 in an assembled state of the product packaging 10. The fastening means 26,28 are form-lockingly connected to the solid product block 12. For attaching the handling means 20 to the solid product block 12, the solid product block 12 comprises a first opening 30 and a second opening 32, arranged at the top 14. The first opening 30 and the second opening 32 may extend from the top 14 to the bottom 18 of the solid product block 12. In an assembled state of the product packaging 12, the first and second fastening means 26, 28 may be fully inserted into the first and second opening 30, 32, holding the handling means 20 by form-lockingly connecting to the solid product block 12.

Figure 2:
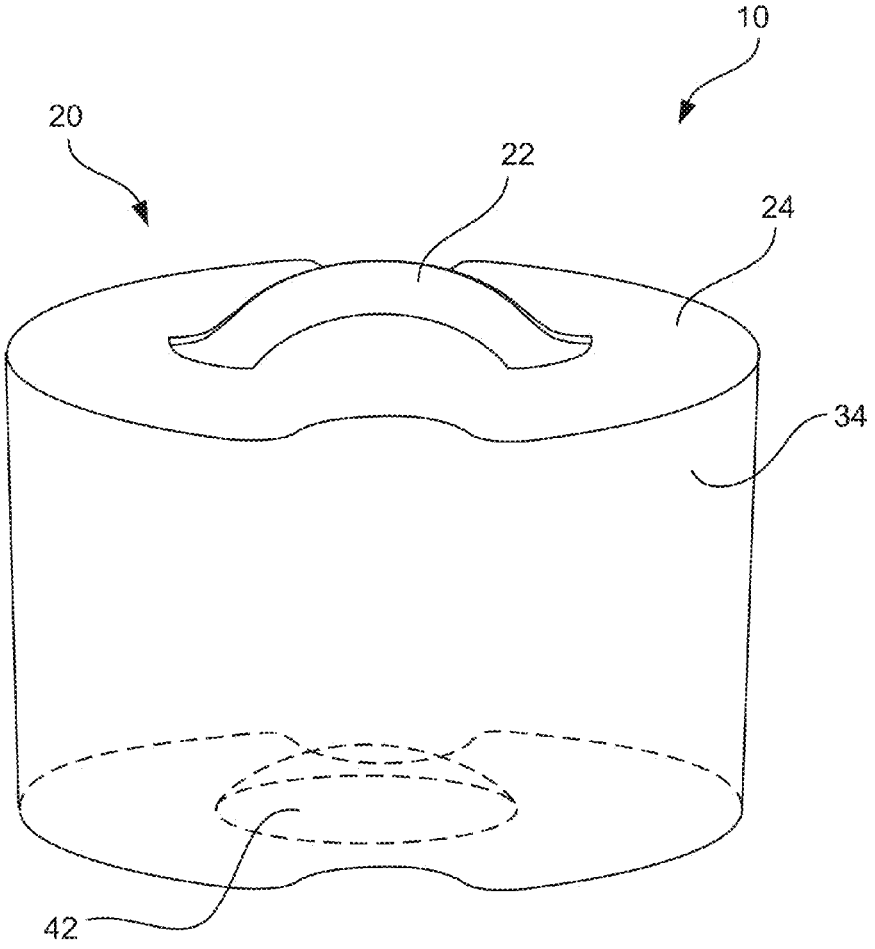
FIG. 2 is a schematic perspective of a product packaging in an assembled state.

FIG. 2 illustrates a product packaging 10 in an assembled state, wherein the handling means 20 in form of a handle 22 with a protective plate 24 is attached to the top 14 of the solid product block 12. The solid product block 12 is enclosed by a wrapping means 34, wherein the wrapping means 34 is in the assembled state of the product packaging 10, arranged in between the top 14 of the solid product block 12 and the protective plate 24 and the handle 22 of the handling means 20. The bottom 18 of the solid product block 12 may comprise a cavity 42 for accommodating a handling means 20 according to the invention when product packagings 10 are stacked on top of each other.

Figure 3:
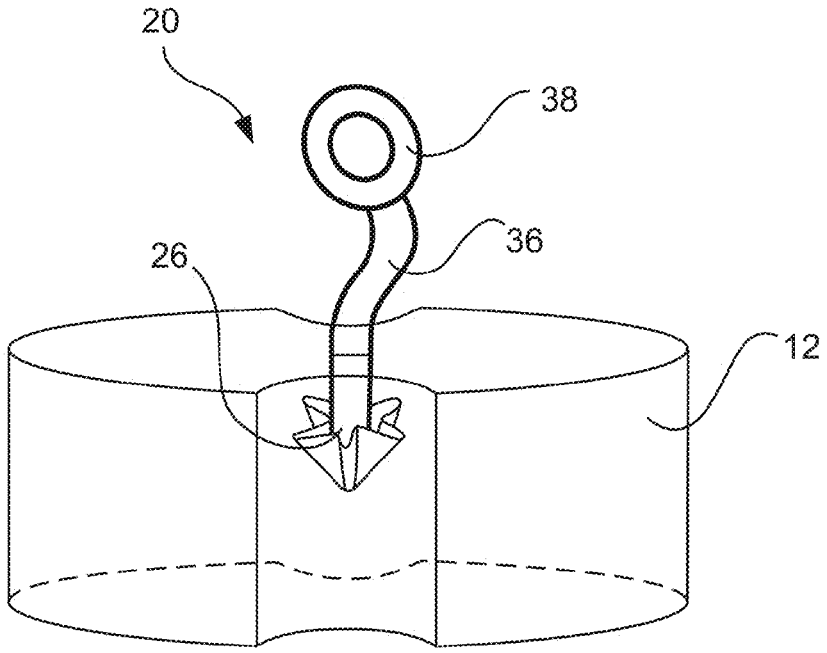
FIG. 3 is an illustration of a product packaging with a handling means in form of a flexible strip.

FIG. 3 illustrates a product packaging 10 comprising a handling means 20 in form of a flexible strip 36. The flexible strip 36 comprises a first fastening means 26, which is form-lockingly arranged inside the solid product block 12, and on an end opposite to the first fastening means, the flexible strip 36 comprises a ring-shaped loop 38, for example to enable an user to handle the handling means 20 with a finger, which may be inserted into the loop 38. The first fastening means 26 shown in FIG. 3 may be placed inside the solid product block 12 during the pressing and shaping of the solid product block 12.

Figure 4:
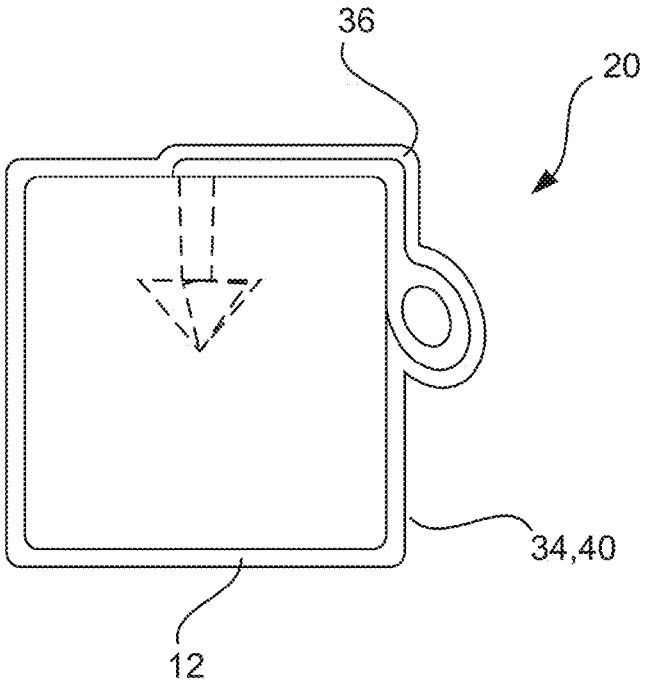
FIG. 4 shows an illustration of a product packaging with a wrapping means in form of a foil.

FIG. 4 shows a product packaging 10 like the one illustrated in FIG. 3 but in a storage state, prior to unpacking. In the storage state, the solid product block 12 and the handling means 20 in form of a flexible strip 36 are completely enclosed by a wrapping means 34, for example in form of a shrinkage foil 40. The shrinkage foil 40 may be water soluble.

The particular combinations of elements and features in the above detailed embodiments are exemplary only; the interchanging and substitution of these teachings with other teachings in this and the patents/applications incorporate by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by the way of example only and is not intending as limiting. In the claims, the wording "comprising" does not exclude other elements or steps, and the identified article "a" or "an" does not exclude a plurality. The mere fact that certain measures are recited in mutually different dependent claims does not indicate that a combination of these measures cannot be used to advantage. The inventions scope is defined in the following claims and the equivalents thereto. Furthermore, reference signs used in the description and claims do not limit the scope of the invention as claimed.

LIST OF REFERENCE NUMERALS

10 product packaging
12 solid product block
14 top
16 side
18 bottom
20 handling means
22 handle
24 protective plate
26 first fastening means
28 second fastening means
30 first opening
32 second opening
34 wrapping means
36 flexible strip
38 loop
40 foil
42 cavity

What is claimed is:

1. A product packaging containing a solid product block for a dispenser system, comprising:

a solid product block having a top, sides, and a bottom;

a handling means attached to the top of the solid product block and including a protective plate having an outside shape corresponding to the shape of the top of the solid product block; and a wrapping means enclosing the solid product block and arranged between the top of the solid product block and the protective plate.

2. The product packaging according to claim 1, characterized in that the handling means comprises a first fastening means form-lockingly connected to the solid product block.

3. The product packaging according to claim 2, characterized in that the top of the solid product block comprises at least a first opening configured and arranged to receive the at least first fastening means.

4. The product packaging according to claim 3, characterized in that:

the handling means further comprises a second fastening means form-lockingly connected to the solid product block;

the top of the solid product block further comprises a second opening configured and arranged to receive the second fastening means;

and the first and second fastening means extend at least partially into the solid product block.

5. The product packaging according to claim 1, characterized in that the handling means is a handle or a flexible strip.

6. The product packaging according to claim 1, characterized in that the bottom of the solid product block comprises a cavity receiving the handling means when stacking product packages.

7. The product packaging according to claim 1, characterized in that the wrapping means is a water-soluble foil.

8. The product packaging according to claim 1, characterized in that the solid product block is formed by pressing or extruding.

* * * * *